US005964423A

United States Patent [19]

Kudrus

[11] Patent Number: 5,964,423

[45] Date of Patent: Oct. 12, 1999

[54] WINDING MACHINE

[75] Inventor: Heiner Kudrus, Barmstedt, Germany

[73] Assignee: Neumag-Neumuenstersche Maschinen-und Anlagenbau GmbH, Neumuenster, Germany

[21] Appl. No.: 08/776,504

[22] PCT Filed: Jul. 8, 1995

[86] PCT No.: PCT/EP95/02674

§ 371 Date: Jan. 10, 1997

§ 102(e) Date: Jan. 10, 1997

[87] PCT Pub. No.: WO96/02453

PCT Pub. Date: Feb. 1, 1996

[30] Foreign Application Priority Data

Jul. 15, 1994 [DE] Germany ..... 44 25 133

[51] Int. Cl.[6] ..... B65H 54/28

[52] U.S. Cl. ..... 242/43 A

[58] Field of Search ..... 242/43 R, 43 A

[56] References Cited

U.S. PATENT DOCUMENTS

| | | | |
|---|---|---|---|
| 3,489,360 | 1/1970 | Torsellinit et al. | 242/43 A |
| 4,505,436 | 3/1985 | Schippers et al. | 242/43 A |
| 4,505,437 | 3/1985 | Schippers et al. | 242/43 A |
| 4,646,983 | 3/1987 | Schippers et al. | 242/43 A |
| 5,174,514 | 12/1992 | Prodi | 242/43 A |
| 5,544,830 | 8/1996 | Kudrus | 242/43 A |

FOREIGN PATENT DOCUMENTS

| | | |
|---|---|---|
| 0 114 642 | 8/1994 | European Pat. Off. . |
| 1710068 | 10/1971 | Germany . |
| 3307915A1 | 9/1984 | Germany . |
| 9307746 | 5/1993 | Germany . |
| 93 07 746 | 8/1993 | Germany . |
| 94/04452 | 3/1994 | WIPO . |

*Primary Examiner*—Michael Mansen
*Attorney, Agent, or Firm*—Michael J. Striker

[57] ABSTRACT

A winding machine has at least two winding stations, each of the winding stations having a clamping device for a bobbin case, a jig motion device, and a contact roller disposed between the clamping device and the jig motion device, the jig motion device having two rotors which are driven in opposite directions and are coupled by a gear, each of the rotors having at least two wings which are arranged in a manner of propellers, rotating in a lower plane of rotation and in an upper plane of rotation, and a distance H is provided between reversing points of a traversing movement, and a plane of a traversing triangle forming an angle with the planes of rotation and the reversing points, while circles of rotation of the rotors of the winding stations overlap each other, also at the winding stations intersecting lines of the planes of rotation together with the plane of the traversing triangle rising in a direction in which the wings of the lower rotor move between the reversing points, in a same direction and at a same angle.

4 Claims, 10 Drawing Sheets

WINDING MACHINE

BACKGROUND OF THE INVENTION

The invention relates to a winding machine.

Wing-type jig motion devices are particularly suitable for employment in connection with high traversing frequencies. In contrast to conventional jig motion devices, the alternating movement of the yarn is not caused by a single yarn guide moving back and forth, but instead by wings rotating in opposite directions which alternately grasp and guide the yarn. Since the wings at the end points of the traversing range are neither accelerated not decelerated, the effect of the inert mass of the yarn guide members is completely removed during yarn reversal.

The tips of the wings of the two rotors moved in opposite directions meet at defined fixed meeting points. The meeting points are distributed on the circle of rotation at even angular distances. The angular distance is a function of the number of wings of a rotor. If, for example, a rotor has two wings, it is 90 degrees. If the rotor has three wings, it is 60 degrees. The position of the polygon formed by the meeting points is a function of the relative phase relation of the two rotors. It is selected in such a way that two neighboring meeting points in the vicinity of the surface of the contact roller lie on a line extending parallel with the axis of the contact roller. These two meeting points are the reversing points of the traversing movement. The wing which respectively is moved in the section between the reversing points guides the yarn. At the end of the section it meets a wing of another rotor, which relieves it of the yarn.

In connection with known winding machines, for example in accordance with DE-OS 33 07 915, the jig motion device has been placed obliquely, so that an acute angle $\alpha$ is created between the two planes of rotation on the one hand and, on the other hand, the plane of the traversing triangle—viewed in the direction of the axis of the contact roller. The traversing triangle is defined by its three corner points. The two base corner points are the end points of the line in which the yarn runs up on the contact roller. The third corner point is the stationary yarn guide element which, in actual use, is mostly attached above the winding machine. The plane of the traversing triangle defined in this way generally does not exactly match the plane through which the yarn moves in the course of the traversing movement. In connection with wing-type jig motion devices this plane is mostly curved. By means of the oblique positioning of the jig motion device it is achieved that the free yarn length between the wing respectively guiding the yarn and the contact roller arranged underneath it is quite short. This favors the exact placement of the yarn on the bobbin.

In known winding machines the intersecting lines between the plane of the traversing triangle and the two planes of rotation are located parallel with the contact line of the contact roller surface with the traversing triangle, i.e. also parallel with the axis of the contact roller. Corresponding to the different distance of the two section lines from the contact line, the drag length at the reversing point to which the wings of the upper plane of rotation lead the yarn is greater than at the reversing point to which the wings of the lower plane of rotation lead the yarn. In this case the "drag length" is the free yarn length between the wing which guides the yarn to the reversing point and the point at which the yarn runs up on the contact roller. In actual operation the difference existing between the drag length at the reversing points can lead to a bobbin structure of differing quality at the two ends of the bobbin.

In the known machine the two rotors of a winding station are seated eccentrically in respect to each other. This step is used to assure a perfect yarn transfer at the ends of the traverse and is widely used in connection with wing-type traversers. The rotor wings of neighboring winding stations are arranged in the same two planes of rotation. The rotors of neighboring winding stations are driven in opposite directions, and in the one plane of rotation they have a lesser axial distance and in the other axis of rotation an axial distance increased by twice the eccentricity. If three or more winding stations are arranged next to each other, from winding station to winding station the rotors of neighboring winding stations, whose wings lie in one plane of rotation, alternatingly have a lesser axial distance and one that is increased by twice the eccentricity.

The arrangement of all wings in only two planes of rotation is stressed as being advantageous, because this makes it possible to keep both the distance between the wings and the distance between the planes of rotation and the run-up line of the yarn on the contact roller—i.e. the drag length—as short as possible. Because the rotors of neighboring winding stations, whose wings are arranged in identical planes of rotation, are driven in opposite directions, the circles of rotation of neighboring rotors—analogously to gear teeth meshing with each other—can overlap in a maximal area without hitting each other or hampering each other. The advantage of achieving a simple gear structure and in particular the synchronization of the traversing movement from one traverse to the next is ascribed to the changing axial distances between the rotors. However, the changing axial distance is a necessary result of the rotation in opposite directions of the wings of neighboring winding stations, whose rotors are seated eccentrically in respect to each other.

It is therefore possible to state in conclusion that the two advantages—short drag length and short distances between neighboring winding stations—are only achieved by tolerating disadvantages, namely different drag lengths at the two ends of the traverse and the different geometry of neighboring winding stations which, in actual operation, can lead to different bobbin structures.

A winding machine with wing-type traversing is known from DE-OS 17 10 068, which apparently has only one single winding station. In this case the axes of rotation of the two rotors form an angle with the axis of rotation of the contact roller, which slightly differs from 90° and whose size is a function of the distance d existing between the two planes of rotation and the traverse H. Therefore the planes of rotation of the two wing arrangements intersect the plane of the traversing triangle at an acute angle in such a way that the drag length at one end of the traverse is of the same size as that at the other end.

SUMMARY OF THE INVENTION

The invention is based on achieving the object of creating a winding machine, wherein the difference between the drag lengths occurring at the reversing points is less than the difference between the two intersecting lines in which the planes of rotation intersect the plane of the traversing triangle, and wherein neighboring winding stations geometrically match.

In this case the direction, in which the wings of the lower rotor move between the reversing points, is fixed by structural characteristics, for example, in the exemplary embodiments to be described below by the arrangement of yarn guide edges at the wings, and by the direction in which the axis of the upper rotor is offset in respect to the axis of the lower rotor. The association between the rotor on the one hand, and the reversing point at which the wings of this rotor release the yarn on the other hand, can in addition or alternatively also be determined by other structural characteristics, for example by the shape of a yarn guide ruler or by special members which affect the yarn transfer at the reversing points.

All three variants of the invention are based on the common basic idea of placing the obliquely-arranged planes of rotation of winding stations disposed next to each other above each other in the manner of fish scales. The oblique positioning, known per se, is used in this manner in accordance with the invention to house a plurality of winding stations in a row next to each other in a narrow space, so that only narrow spaces exist between the individual traversing areas. In addition, the effect of the oblique placement known from the prior art, namely the matching of drag lengths on both sides, is realized at least to a considerable degree. Depending on the selected dimensional conditions and the selected variant of the invention, the rise of the intersecting lines can slightly differ from the angle at which the drag lengths are exactly the same at both ends of the traversing area. But in every case the height of the reversing point, measured from the base line of the traversing triangle, at which the wings of the lower plane of rotation release the yarn, is approximated to the height of the other reversing point at which the wings of the upper plane of rotation release the yarn.

The preferred variant in accordance with claim 1 has the advantage that the wings of all rotors of neighboring winding stations rotate independently of each other in separate planes of rotation. For this reason collisions are impossible which, in known winding machines occur, for example when a drive belt of a winding station breaks and which can cause expensive damage to the machines and interruptions of the operation in the process. The difference in the drag lengths caused by the increased distance between the planes of rotation and both reversing points is reduced to a negligible degree by the oblique positioning.

The increased distance between the planes of rotation offers the advantageous option to dispose the ruler at each winding station between the planes of rotation. Because of this the distance between the wing guiding the yarn and the ruler is always of the same size, regardless whether a wing of one or the other rotor guides the yarn. This is advantageous for the bobbin structure. The members for fastening and setting the ruler are easily accessible.

Depending on the conditions of the individual case it is advantageous to provide each winding station with its own drive elements. This is made possible because the wings of the individual winding stations rotate independently of each other.

In another variant the drag lengths are of approximately the same length at all reversing points.

Further variant combines the advantage of drag lengths of almost the same size with the advantage that the wings of neighboring winding stations rotate independently in separate planes of rotation.

BRIEF DESCRIPTION OF THE DRAWINGS

The drawings are used for explaining the invention by means of exemplary embodiments represented in a simplified manner.

DESCRIPTION OF PREFERRED EMBODIMENTS

Figure 1A:
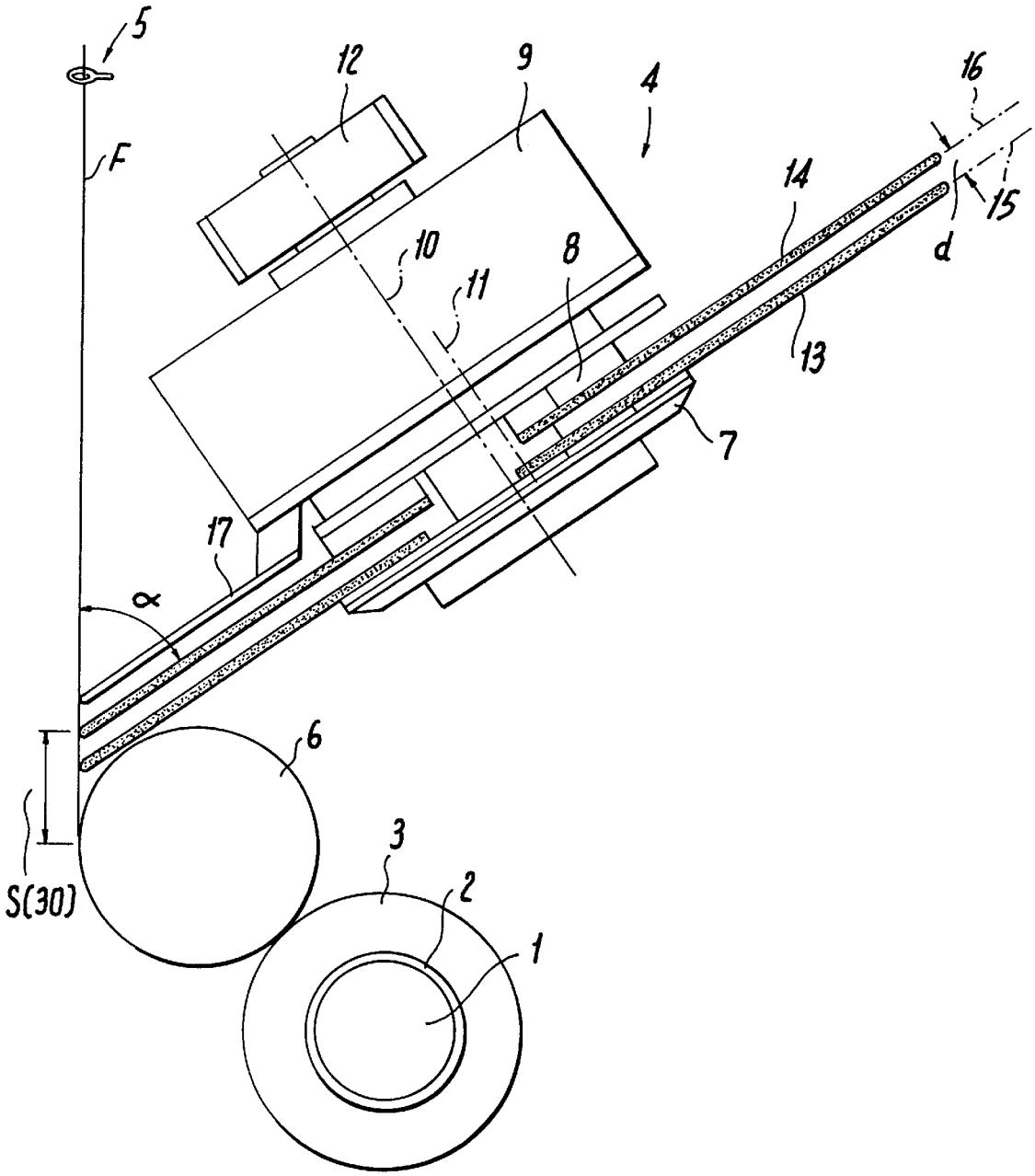
FIG. 1*a* shows a lateral view of a winding machine in accordance with the invention at a defined moment.
Figure 1B:
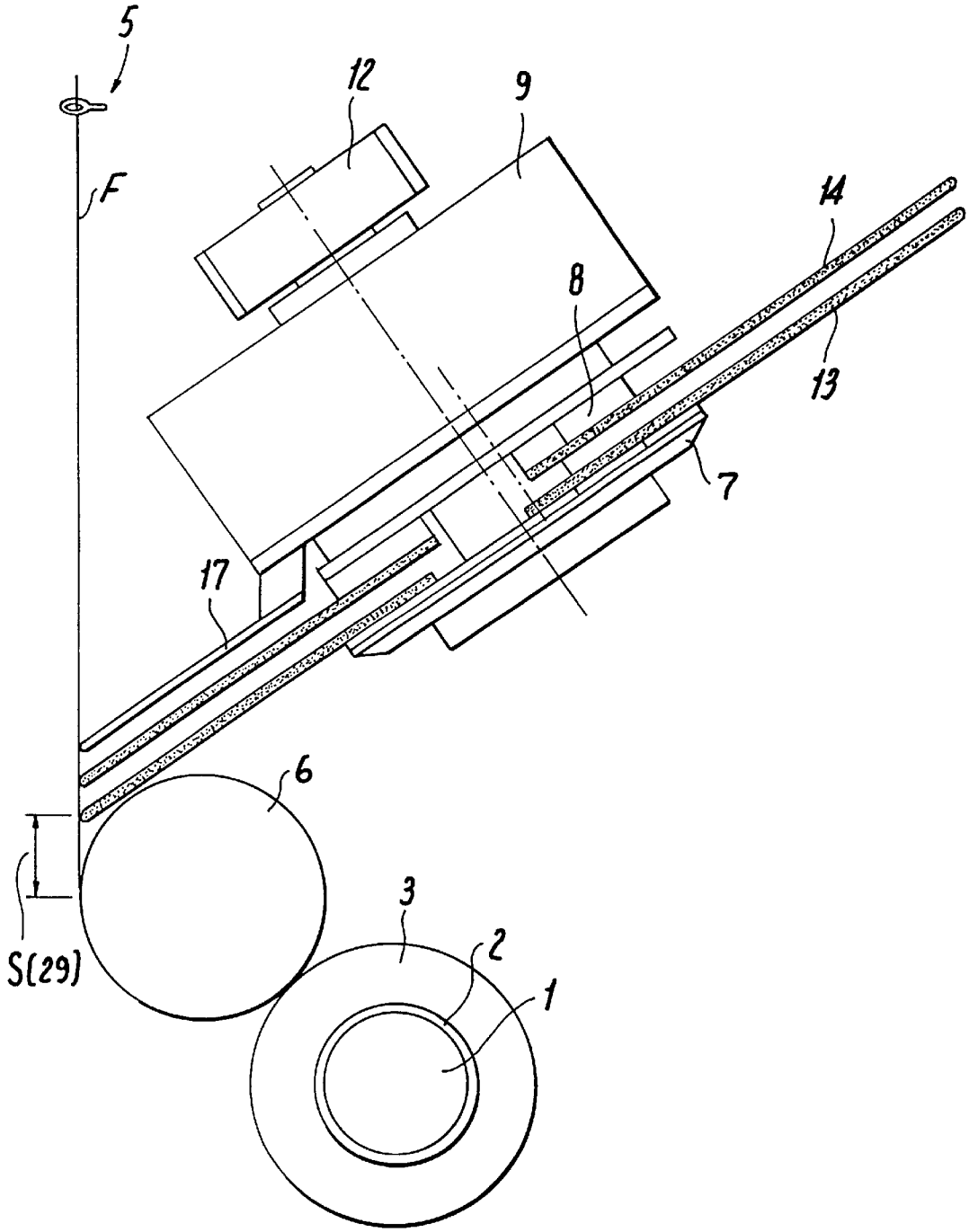
FIG. 1*b* shows the corresponding lateral view at another moment.

A spool spindle 1, on which a bobbin case 2 of a bobbin which is just being built is clamped, is connected in a known manner with a machine frame not represented in FIGS. 1*a*, 1*b*. A jig motion device 4 for a yarn F, which is fed perpendicularly from above over a yarn guide 5, is also fastened on the machine frame above the spool spindle 1. A contact roller 6 is disposed between the spool spindle 1 and the jig motion device 4, whose axis is aligned horizontally and parallel with the axis of the spool spindle 1.

Figure 2:
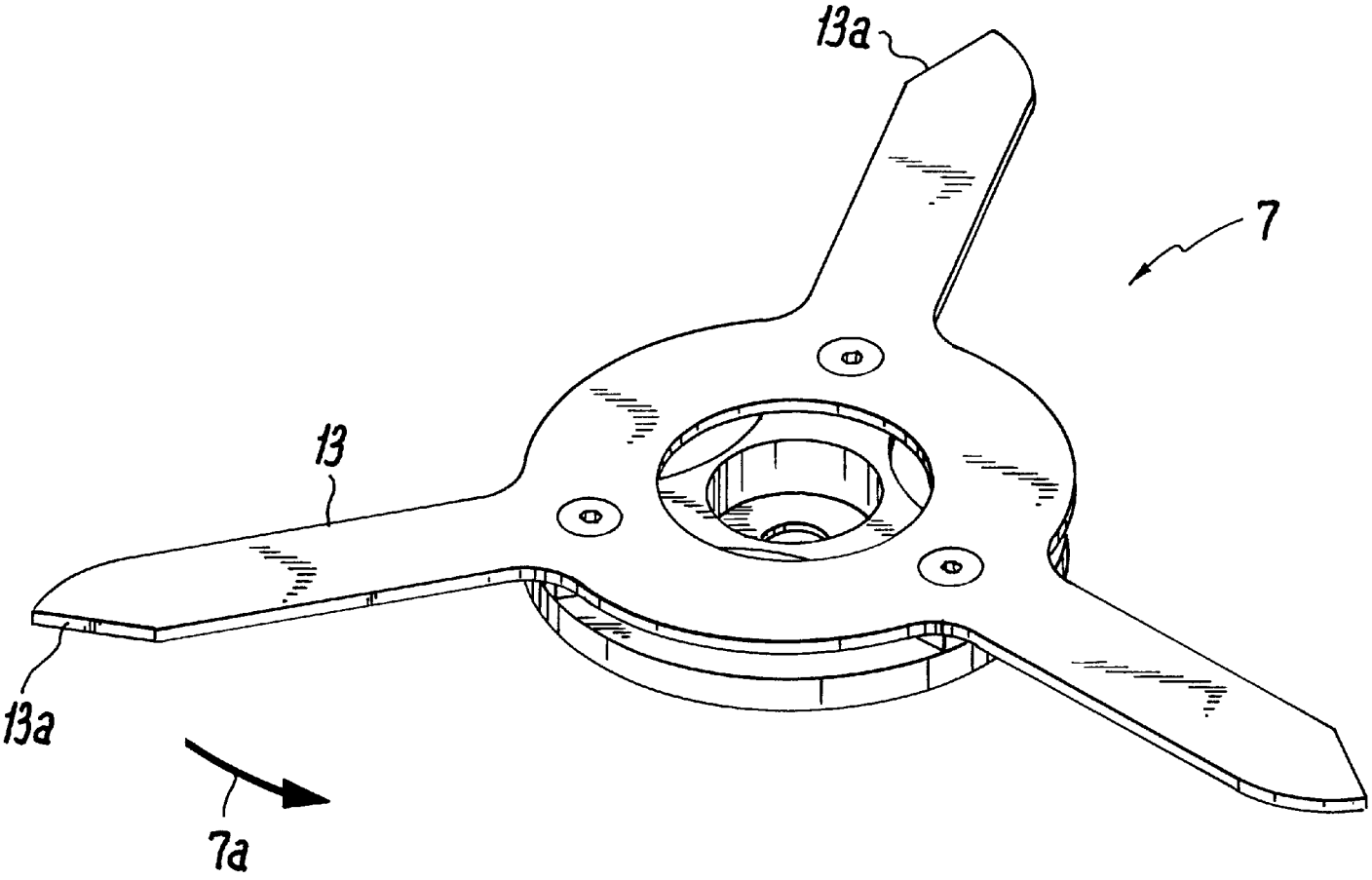
FIG. 2 perspectively represents a rotor.

Two rotors 7, 8, which are rotatably seated in a housing 9, are part of the jig motion device 4. As known, for example from DE 93 07 746 U, the axes of rotation 10, 11 are disposed spaced parallel at short distances from each other. The rotors 7, 8 can be driven in opposite directions at the same rpm by means of a drive device, of which only a toothed disk 12, which is part of the rotor 7, can be seen in FIGS. 1*a*, 1*b*. As can be seen in FIG. 2, the rotor 7 has three wings 13 arranged in the manner of a propeller, the rotor 8 has correspondingly arranged wings 14. In accordance with FIG. 2, each wing 13 has a yarn guide edge 13*a* near its tip on the side located at the front in the direction of rotation 7*a*. Similar is true for the wings 14.

The wings 13 of the rotor 7 rotate in a lower plane of rotation 15, the wings 14 of the rotor 8 in an upper plane of rotation 16. In this case the "lower plane of rotations" is understood to be the one adjacent to the contact roller 6. For the sake of simplicity this is also intended to apply in connection with possible other winding machines, in which the running direction of the yarn and correspondingly the alignment of the machine differs from FIGS. 1*a*, 1*b*. The short distance between the two planes of rotation 15, 16 equals d. The axes 10, 11 are placed obliquely, so that the two planes of rotation 15, 16 form an acute angle a with the plane of the traversing triangle in the drawing plane of FIGS. 1*a*, 1*b*. A ruler 17, along which the yarn F is moved back and forth along the traversing path, is disposed in the customary manner at a short distance above the upper plane of rotation 16.

Figure 3:
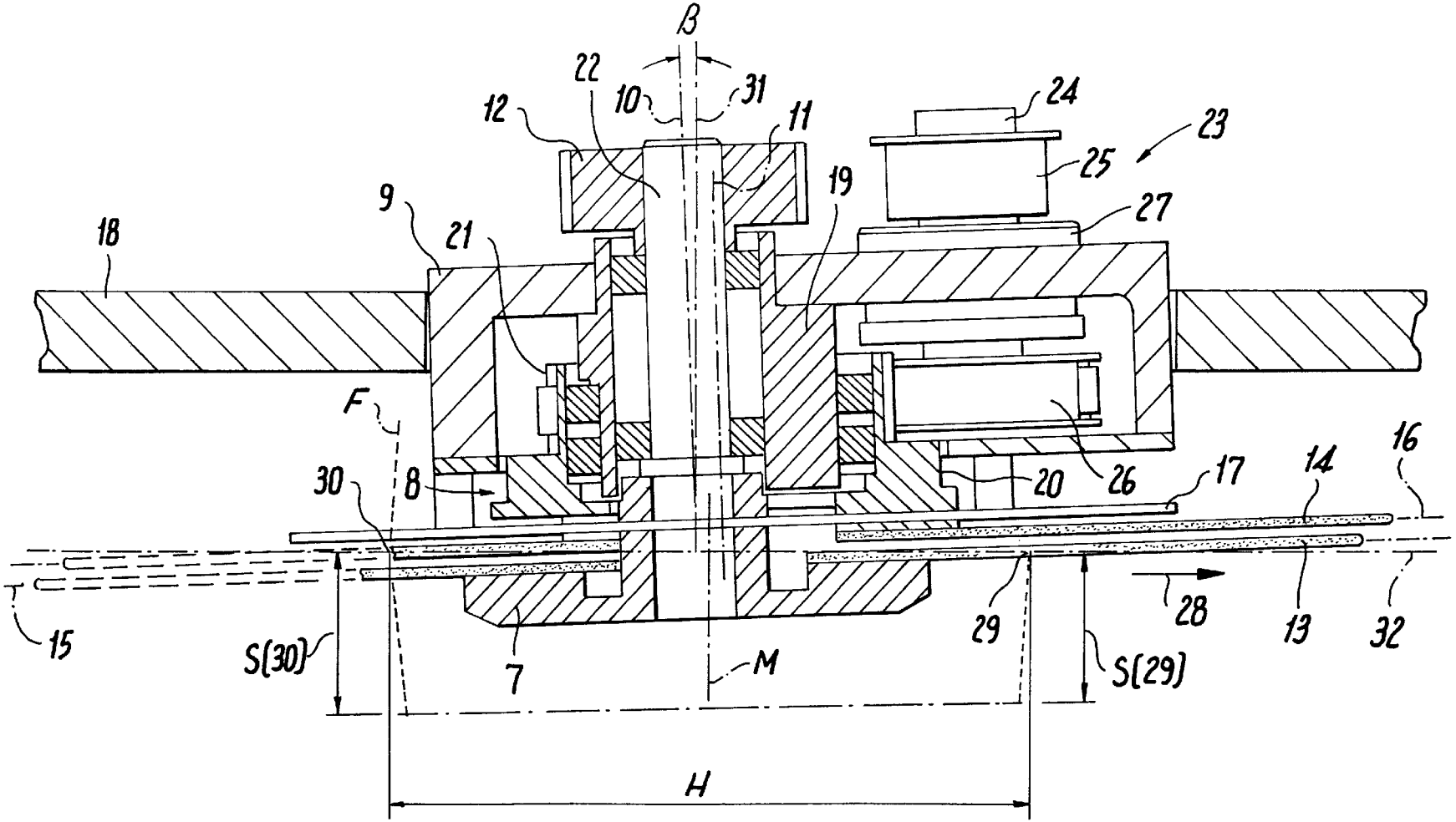
FIG. 3 shows a section through an individual winding station in a plane located parallel with the traversing movement.

In connection with an exemplary embodiment, FIG. 3 shows details which cannot be seen in FIGS. 1*a*, 1*b*. A base plate 18, which is part of the machine frame, supports the housing 9. An eccentric bushing 19 is seated therein, on the cylindrical surface area of which the rotor 8 is seated. The latter essentially consists of a ring-shaped base body 20, a toothed collar 21 seated on the base body, and the wings 14. The eccentric bushing 19 has a bore, whose axis 10 is displaced parallel in respect to the axis 11 of the surface area. A shaft 22 of the rotor 7 is seated in the bore. The one end of the shaft 22 projects downward past the plane of rotation 16 and supports the propeller-like wings 13. The toothed disk 12 is seated on the other end of the shaft 22. A roller 23, consisting of a shaft 24, a first gear wheel 25 and a second gear wheel 26, is seated next to the pair of rotors 7, 8. The shaft 24 is rotatably seated in a bearing bushing 27 which is screwed to the housing 9. The gear wheels 25, 26, which are connected with the ends of the shaft 24, are associated with the toothed disk 12 or the toothed collar 21. An O-shaped toothed belt is looped around the toothed collar 21 and the gear wheel 26 in the manner of an open belt drive. A drive belt, not represented in FIG. 3, which is toothed on both sides, loops around the toothed disk 12 and the gear wheel 25 with alternating sides in the approximate shape of a letter S, so that the rotors 7, 8 are driven in opposite directions at the same rpm and in a constant relative phase relation.

In the arrangement in accordance with FIG. 3, the lower rotor 7 rotates during operation in such a way that the tips of the wings 13 rise out of the plane of the drawing at the left side, move from left to right in accordance with the arrow 28 and dip back again into the plane of the drawing at the right side. The rotor 8 with the wings 14 rotates in the opposite direction.

The relative phase relation between the two rotors 7, 8 has been selected in such a way, that the two meeting points 29, 30, where the tips of the wings 13 encounter the tips of the wings 14, are located at least approximately in the perpendicular plane containing the yarn guide 5 and touching the contact roller 6. This plane is the plane of the traversing triangle. The two meeting points 29, 30 are the reversing points, their distance is the traverse H. Since in the represented exemplary embodiment the rotors 7, 8 each have three wings, the traverse is approximately equal to half the diameter of the circle on which the wing tips travel.

In connection with jig motion devices wherein the axes of the two rotors are offset from each other in a direction which is parallel or oblique in respect to the axis of the contact roller, the wing which respectively guides the yarn moves in the direction toward the reversing point which—viewed from the center of its circle of rotation—is located on the other side of the plane of symmetry M of the traversing area. For FIG. 3 it follows from this that the wings 13 of the lower rotor 7 guide the yarn to the reversing point 29, the wings 14 of the rotor 8 guide it to the reversing point 30.

The axis 10 has been obliquely placed, so that with an imagined perpendicular line 31 it forms a small angle β. The axis 11 is parallel with the axis 10 and therefore also placed obliquely in the same amount. Correspondingly, the planes of rotation 15, 16 are also placed obliquely, so that the intersection lines in which they intersect the plane of the traversing triangle form an angle β with a horizontal line. Thus, they rise in the direction toward the reversing point 29, i.e. in the direction in which the wings 13 of the lower rotor 7 move from the reversing point 30 to the reversing point 29 in accordance with the arrow 28. The two intersection lines have a distance of d:sin α from each other. At an optimal angle βo, the intersection line of the plane of rotation 15 intersects the horizontal line 32 at the reversing point 29, the intersection line of the plane of rotation 16 the same horizontal line 32 at the reversing point 30. It follows from simple geometric considerations that for this it is necessary that the angle βo must meet the condition $$\beta o = \arctan\frac{d}{H \cdot \sin\alpha}$$

In connection with the small angles βo under consideration, this condition can be simplified with a very good approximation as follows:

$$\beta o = \arctan\frac{d}{H \cdot \sin\alpha} \cdot 57.3°.$$

If the axes of rotation 15, 16 rise at the angle βo, the drag length S (29), S (30) at the two reversing points are exactly equal. In connection with the various variants of the invention described hereinafter, angles β result for simple geometric reasons, which diverge from the angle βo because of the line-up of several winding stations. If the angle β is less than the angle βo, the difference Delta S between the drag lengths at the two reversing points 29, 30, which is a result of the distance between the planes of rotation 15, 16, is only partially compensated. If the angle β lies between βo and 2βo, it is overcompensated. However, in both cases the difference Delta S is reduced in comparison with an arrangement in which the intersection lines of the planes of rotation 15, 16 lie horizontally with the plane of the traversing triangle.

Figure 4:
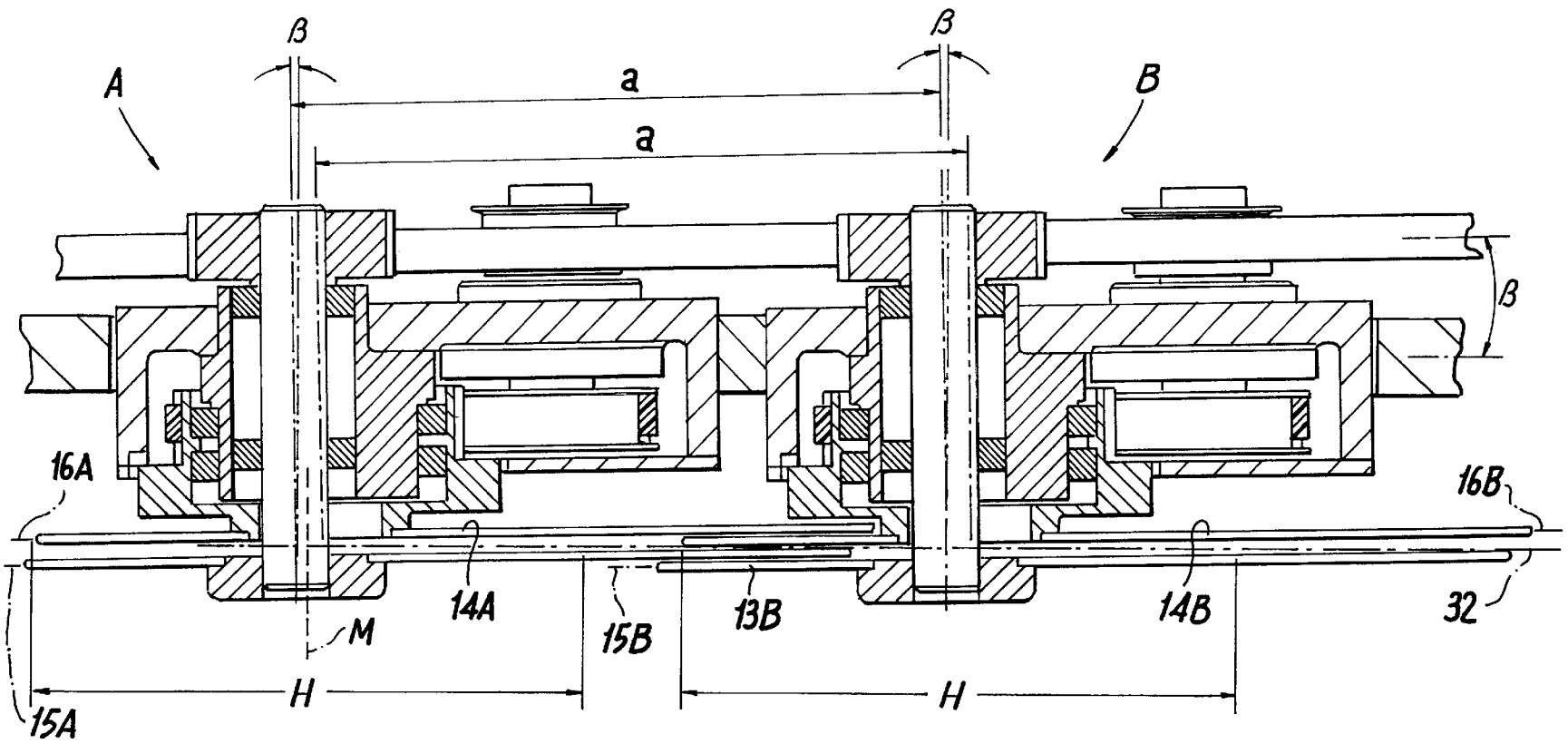
FIG. 4 shows a section corresponding to FIG. 3 for a winding machine with two winding stations.

The two winding stations A, B of the same construction, which are disposed next to each other in accordance with FIG. 4, agree to a large extent with the winding station in accordance with FIG. 3, so that a description can be omitted to that extent. The distance a between the similarly laid out axes of rotation of the two winding stations A, B is considerably less than the diameter of the circle of rotation of the wing tips. It is approximately 20 to 30% greater than the traverse H. As a result, the circles of rotation of the two winding stations overlap over a wide area.

In comparison with FIG. 3, the distance between the planes of rotation 15A, 16A in which the wings 13A, 14A rotate is increased, and also the distance between the planes of rotation 15B and 16B. The plane of rotation 15A lies between the planes of rotation 15B and 16B, and in the same way the plane of rotation 16B lies between the planes of rotation 15A and 16A. Thus, the wings of the two winding stations can move in the overlapped area independently of each other without interfering with each other.

On account of the geometric conditions resulting from the placement of the two winding stations next to each other and the fish scale-like overlapping of the planes of rotation, the angle β is less than the optimal angle βo. However, the angle β is sufficient for noticeably reducing the difference Delta S between the drag lengths at the two reversing points.

Figure 4A:
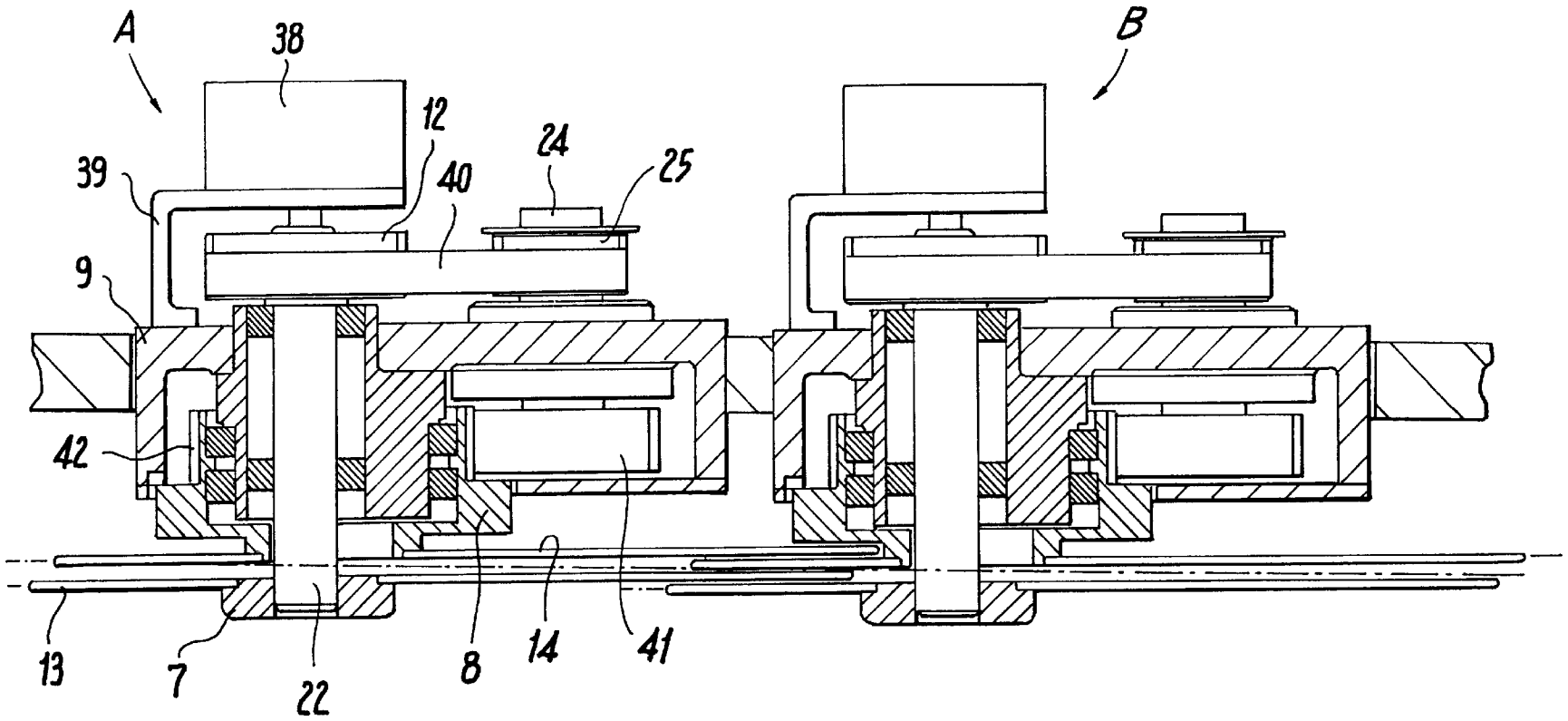
FIG. 4*a* shows another embodiment of the winding machine in accordance with the present invention.
Figure 5:
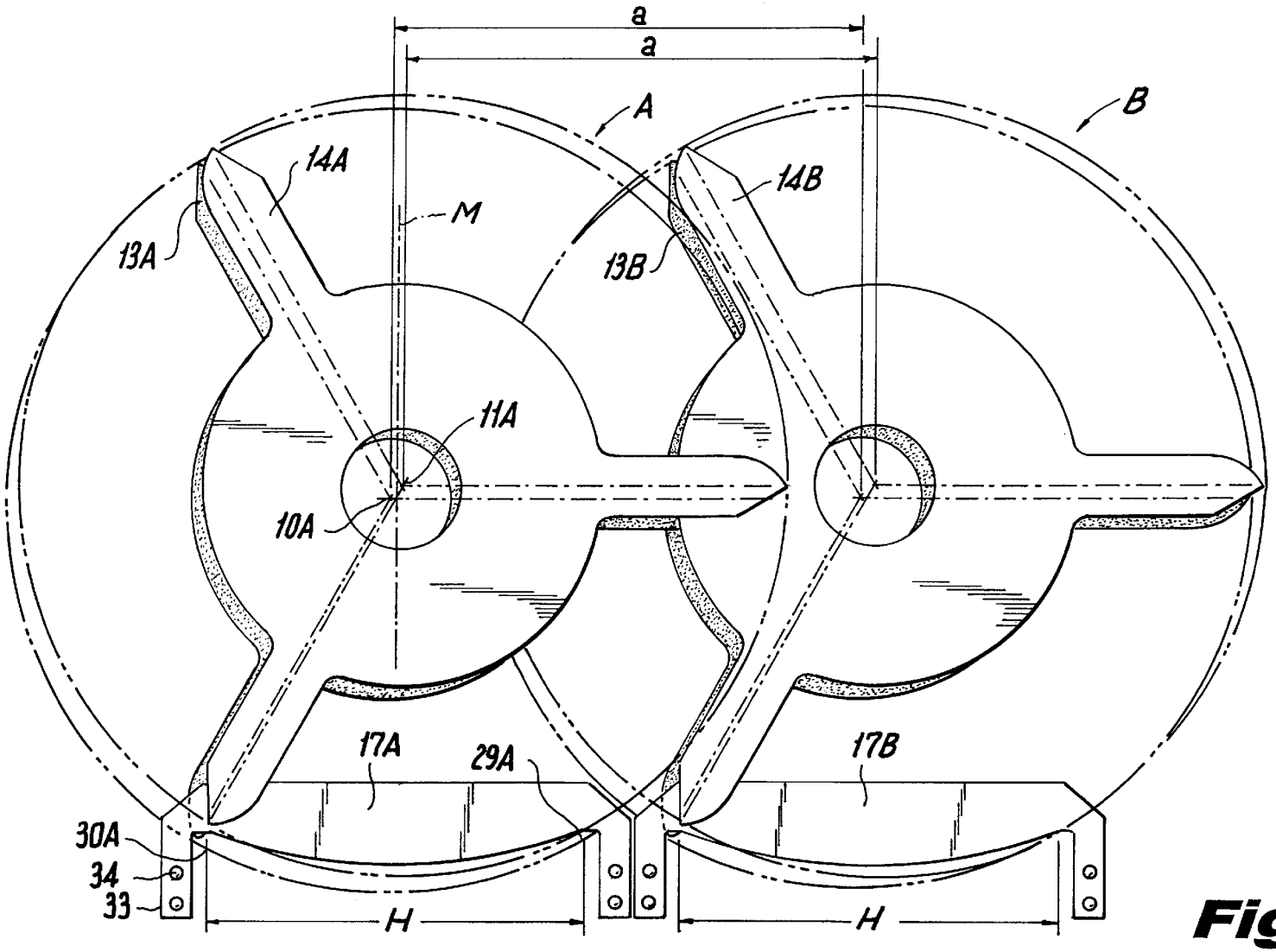
FIG. 5 in a top view represents the arrangement of the rotors in the exemplary embodiment of FIG. 4.

Different from FIG. 3, in the exemplary embodiment in accordance with FIGS. 4 and 5 the rulers 17A, 17B (not represented in FIG. 4 for reasons of clarity) are disposed between the planes of rotation 15A, 16A or 15B, 16B. They are provided with brackets 33 at the ends, which are fastened by means of screws 34 on the machine frame outside of the circles of rotation. FIG. 4*a* shows another embodiment of the inventive winding machine. This embodiment differs from the embodiment of FIG. 4 in that the individually winding stations A and B have separate drive devices. Since the drives of both winding stations are completely identical, it suffices to describe only one drive for the winding station A. The drive has a drive motor 38 which is mounted through a bracket 39 on the housing 9 and is coaxially connected with the shaft 22. A toothed collar 21 surrounds in a O-shaped manner the gear wheel 12 and the gear wheel 25, so that the shaft 24 rotates in the same direction as the shaft 22. Analogously to the gear wheel 26 of FIG. 3, a second gear wheel 31 is arranged on the shaft 24. It engages with the toothed collar 42 which, analogously to the toothed collar 21 of FIG. 3 is arranged on the base body 20 of the rotor 8. Thereby the rotors 7 and 8 rotate in opposite directions.

The offset arrangement of the axes 10A, 11A can be clearly seen in FIG. 5. The axis 11A is offset obliquely rearward in respect to the axis 10A—viewed from the plane of the traversing triangle. In respect to the plane of symmetry M of the traversing area, the axis 10A is located on the same side as the reversing point 30A, the axis 11A on the same side as the reversing point 29A. Similar is true for the winding station B.

Figure 6:
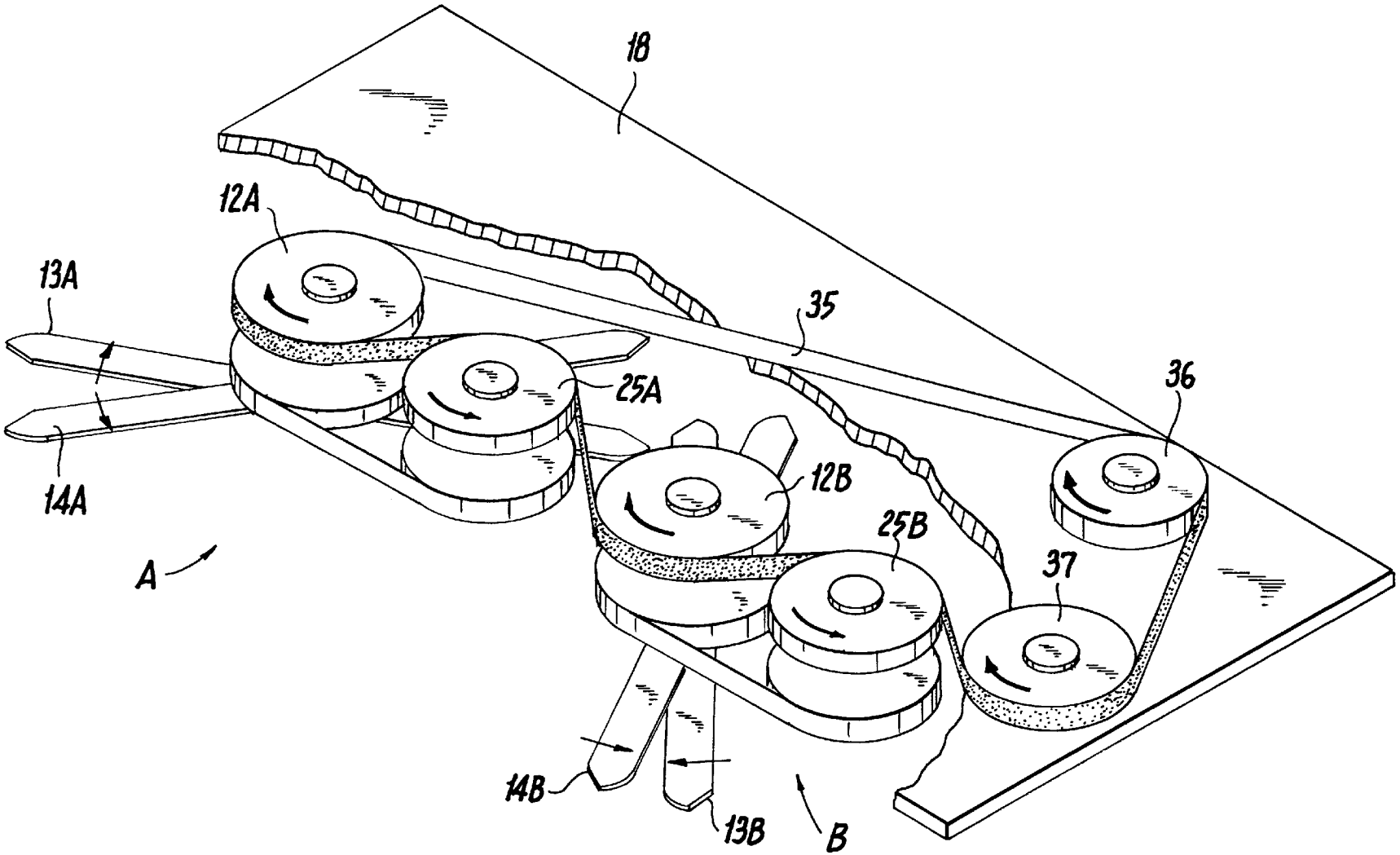
FIG. 6 shows a perspective view of a driving device suitable for the exemplary embodiment of FIG. 4.

In accordance with FIG. 6, a common drive for two winding stations arranged next to each other, wherein the rotors each have two wings, is embodied as a multi-shaft gear.

A drive belt 35, toothed on both sides, which meshes with a toothed drive disk 36, loops with alternating sides around the toothed disk 12A, the gear wheel 25, the toothed disk 12B and the gear wheel 25B. It is returned to the drive disk 36 via a toothed reversing disk 37 disposed next to the gear wheel 25B. In this arrangement the lower wings 13A rotate in the same direction as the lower wings 13B of the neighboring winding station, the upper wings 14A in the same direction as the upper wings 14B.

Since the wings of neighboring winding stations can be moved independently of each other, it is not necessary to match the phase relations of neighboring winding stations to each other. For the same reason it is also possible to provide the individual winding stations with independent individual drive devices or—as known per se—to drive them mutually in such a way that corresponding rotors of neighboring winding stations rotate in opposite directions.

Figure 7:
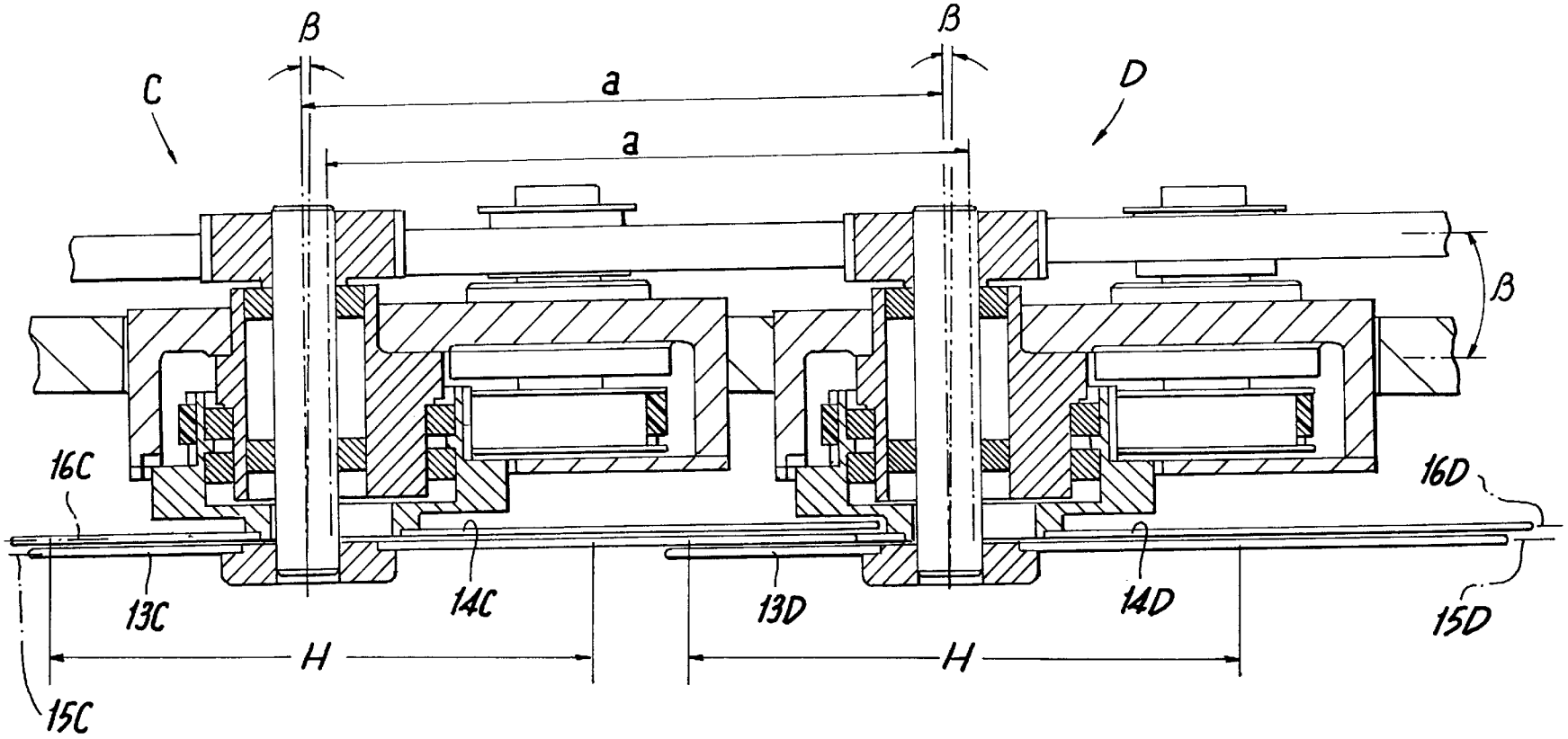
FIG. 7 shows a further exemplary embodiment in a section corresponding to FIG. 4.

The exemplary embodiment represented in FIG. 7, in which winding stations C, D of the same construction are disposed next to each other, differs from the exemplary embodiment in accordance with FIG. 4 in particular in that the planes of rotation 15C, 16C or 15D, 16D are arranged closer to each other, similar as in FIG. 3. The lower plane of rotation 15C is identical with the upper plane of rotation 16D of the neighboring winding station. This is made possible in that the wings 13C mesh with the wings 14D in the overlap area, similar to the teeth of two gear wheels. It is a prerequisite that the wings 13C rotate in the opposite direction from the wings 14D. When employing a drive device in accordance with FIG. 6, the phase relation must be matched in such a way that a wing 13C enters into the gap between two wings 14D and vice versa. The angle β lies close to the optimal angle βo, so that the drag lengths at the reversing points are approximately the same size.

Figure 8:
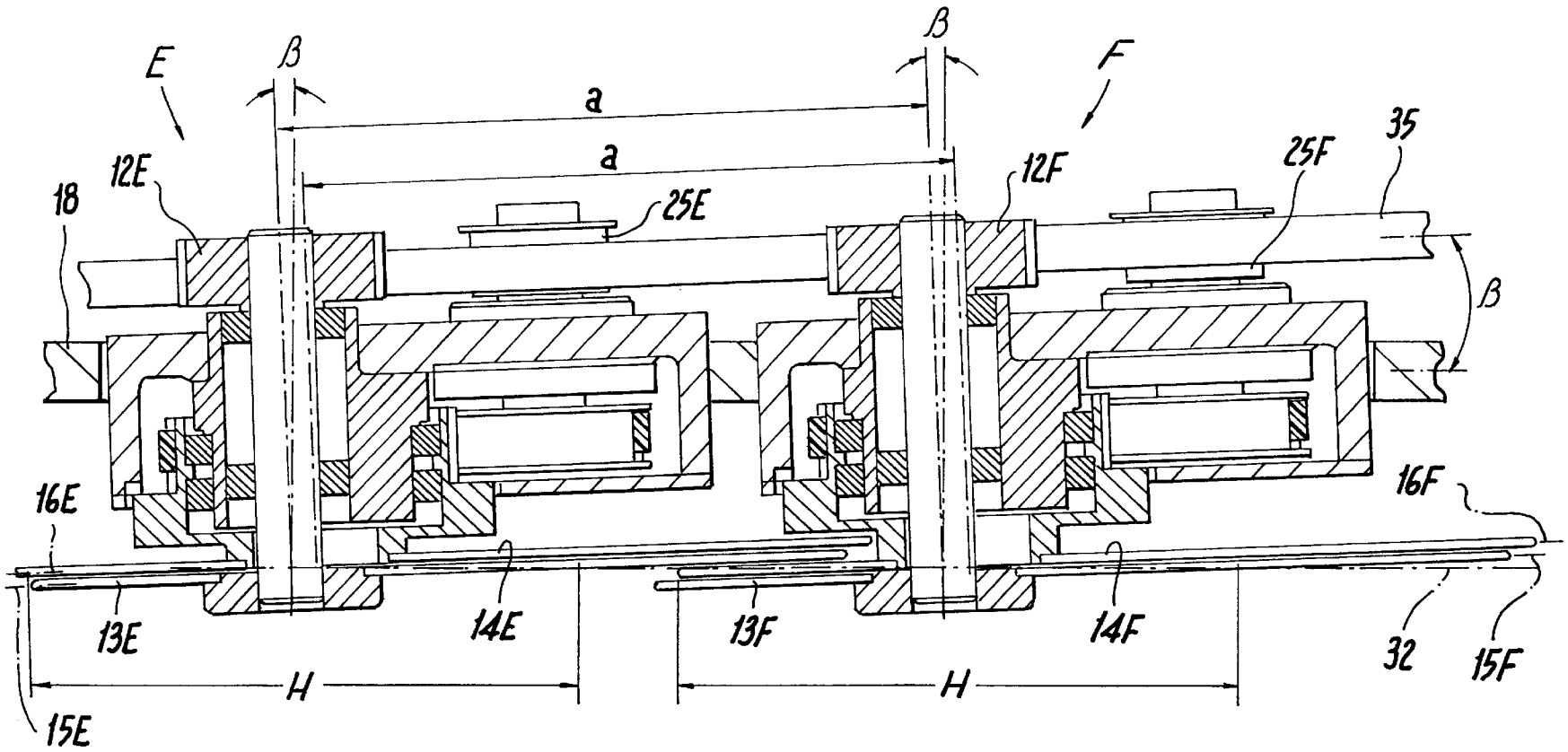
FIG. 8 shows a further exemplary embodiment in a section corresponding to FIG. 4.

In the exemplary embodiment in accordance with FIG. 8, another winding station F of the same construction is also disposed next to a winding station E. Different from FIG. 7, the lower plane of rotation 15E of the winding station E here is located above the upper plane of rotation 16F of the other winding station F and at such a distance that the wings 13E and 14F can rotate independently of each other without colliding with each other in the overlap area of the winding stations E, F. In a practical way the distances between respectively two neighboring planes of rotation 16E, 15E, 16F, 15F are all the same. Based on simple geometric relationships, the result is that the angle β, which the planes of rotation 15E, 16E, 15F, 16F form with the horizontal line 32, is greater in this arrangement than with the previously described exemplary embodiments. It is slightly larger than the optimal angle βo, so that the height difference in respect to the drag length existing between the planes of rotation 15E, 16E or 15F, 16F is overcompensated. At the reversing point located to the right in the drawings, where the lower wings 13E, 13F release the yarn, the drag length is slightly greater than at the other reversing point to which the upper wing 14E, 14F feed the yarn. The difference Delta S is clearly less than d: sin α.

FIG. 8 also makes it clear that the drive belt 35 rotates in a plane which also forms an angle β with the horizontally placed base plate 18. This is made possible in a simple manner in that the toothed disks 12E, 12F and the gear wheels 25E, 25F have a larger width (dimension in the direction of the axis) than the toothed belt 35. The latter therefore loops around the toothed disk 12E in the vicinity of its lower rim, the gear wheel 25E, around the toothed disk 12F and the gear wheels 25F at increasing distances from the lower rim.

For the sake of simplicity, exemplary embodiments having only two winding stations have been selected for FIGS. 4 to 8. It need not be mentioned that it is also possible without difficulties to line up three or more winding stations analogously with FIGS. 4 to 8.

I claim:

1. A winding machine, comprising at least two winding stations, each of said winding stations having a clamping device for a bobbin case, a jig motion device, and a contact roller disposed between said clamping device and said jig motion device, said jig motion device having two rotors which are driven in opposite directions and are coupled by a gear, each of said rotors having at least two wings which are arranged in a manner of propellers, said wings of one of said rotors rotating in a lower plane of rotation and said wings of the other of said rotors rotating in an upper plane of rotation which is located a short distance d above said lower plane of rotation, and a distance H is provided between reversing points of a traversing movement, and a plane of a traversing triangle forming an angle α with said planes of rotation and said reversing points, while circles of rotation of said rotors of said winding stations overlap each other, at said winding stations intersecting lines of said planes of rotation together with said plane of said traversing triangle rising in a direction in which said wings of said lower rotor move between said reversing points, in a same direction and at a same angle β which satisfies the following equation $$0 < \beta < 2\arctan\frac{d}{H \cdot \sin\alpha},$$

said lower plane of rotation of one of said winding stations where said intersecting lines of said planes of rotation rise in a direction toward a neighboring of said winding stations lying between said planes of rotation of said one winding station, and said upper plane of rotation of said neighboring winding station lying between said planes of rotation of said one winding station, said planes of rotation being arranged at distances at which all said wings are rotatable independently of each other.

2. A winding machine as defined in claim 1, and further comprising a machine frame; and a ruler disposed between said planes of rotation of each of said winding station and provided with lateral brackets which are fastened on said machine frame outside of said circles of rotation.

3. A winding machine as defined in claim 1, wherein said winding stations are provided with separate drive devices.

4. A winding machine, comprising at least two winding stations each having a clamping device for a bobbin case, a jig motion device, and a contact roller disposed between said clamping device and said jig motion device, said jig motion device having two rotors which are driven in opposite directions and coupled by gear, each of said rotors having two wings which are arranged in a manner of propellers, said wings of one of said rollers rotating in a lower plane of rotation and said wings of the other of said rotors rotating at an upper plane of rotation which lies a short distance d above said lower plane of rotation, so that a distance H exists between reversing points of a traversing movement, and a plane of a traversing triangle forms an angle α with said planes of rotation in said reversing points, and circles of rotation of said rotors of said winding stations overlap each other, also intersecting lines of said planes of rotation at said winding stations together with said plane of said traversing triangle rising in a direction in which said wings of said lower rotor move between said reversing points, in a same direction and at a same angle β which satisfies the following equation $$0 < \beta < 2\arctan\frac{d}{H \cdot \sin\alpha},$$

said lower plane of rotation of one of said winding stations where said intersecting lines of said planes of rotation rise in a direction toward a neighboring of said winding stations lying above said upper plane of rotation of said neighboring winding station, and said planes of rotation being arranged at a distance at which said wings rotating in said planes of rotation are rotatable independently of each other.

* * * * *